United States Patent [19]

Van Cang

[11] Patent Number: 4,710,764

[45] Date of Patent: Dec. 1, 1987

[54] DEVICE FOR OBTAINING CONTINUOUS PLOTS ON THE SCREEN OF A DISPLAY CONSOLE CONTROLLED BY A GRAPHIC PROCESSOR

[75] Inventor: Luc P. Van Cang, Savigny Sur Orge, France

[73] Assignee: Thomson Video Equipment, Gennevilliers, France

[21] Appl. No.: 723,276

[22] Filed: Apr. 15, 1985

[30] Foreign Application Priority Data

Apr. 17, 1984 [FR] France ..... 8406053

[51] Int. Cl.[4] ..... G09G 1/16

[52] U.S. Cl. ..... 340/728; 340/721; 340/747; 340/722

[58] Field of Search ..... 340/728, 721, 742, 744, 340/703, 722

[56] References Cited

U.S. PATENT DOCUMENTS

| | | | |
|---|---|---|---|
| 4,303,986 | 12/1981 | Lans | 340/703 |
| 4,396,912 | 8/1983 | Pozzi | 340/728 |
| 4,489,389 | 12/1984 | Beckwith et al. | 340/728 |
| 4,532,503 | 7/1985 | Pennebaker | 340/728 |
| 4,544,922 | 10/1985 | Watanabe et al. | 340/728 |
| 4,586,037 | 4/1986 | Rosener et al. | 340/728 |

FOREIGN PATENT DOCUMENTS 0092973 2/1983 European Pat. Off. .

*Primary Examiner*—Gerald L. Brigance

*Attorney, Agent, or Firm*—Oblon, Fisher, Spivak, McClelland, & Maier

[57] ABSTRACT

Device for obtaining continuous plots on the screen of a display console controlled by a graphic processor, comprising a graphic memory for storing in binary form the matrix of points or pixels representing the image displayed on the screen and an attribute memory containing the attributes of each of the points of the image. An interpolation circuit contains a table for calculating the attributes of the intermediate points between consecutive points of the dot matrix. The table of the interpolation circuit is addressed by the preexisting value PA of the pixel to be modified found in the attribute memory, by the value PN of the attribute of the pixels on the plot on either side of the point to be modified and by an interpolation value F equal to the fractional part of the position of the point to be modified between consecutive points on the plot, each position in the table containing an attribute value PM confirming the relationship $$PM=F.PA+(1-F).PN,$$

the value PM obtained is transferred into the attribute memory for updating the contents of the position corresponding to the address of the modified point.

7 Claims, 8 Drawing Figures

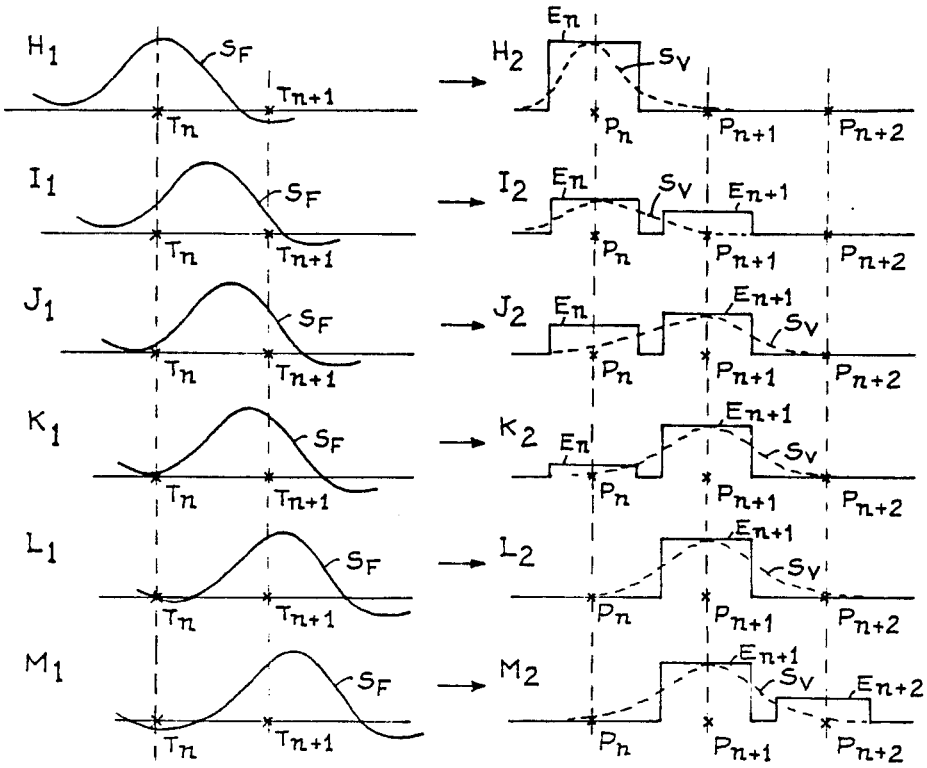
Fig. 3 PRIOR ART
PRIOR ART Fig. 4
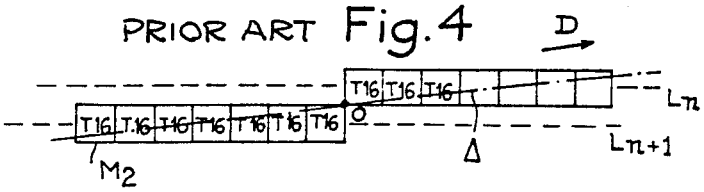
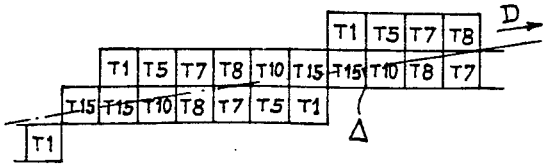
Fig. 5 PRIOR ART
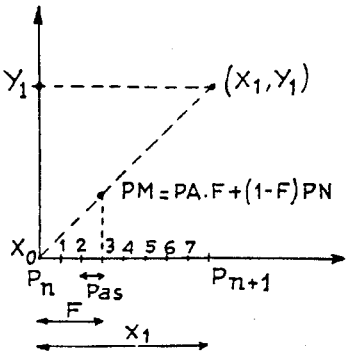
Fig. 8

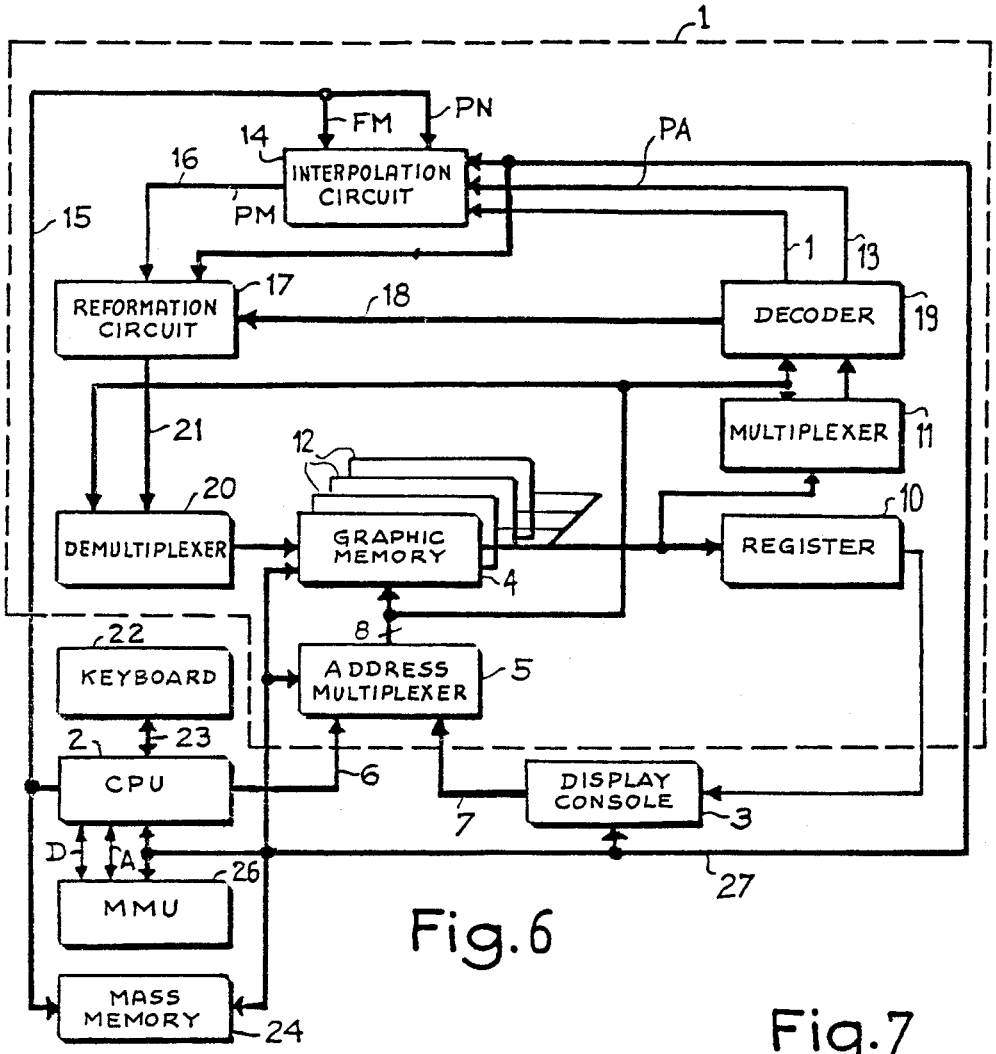
Fig.6
Fig.7
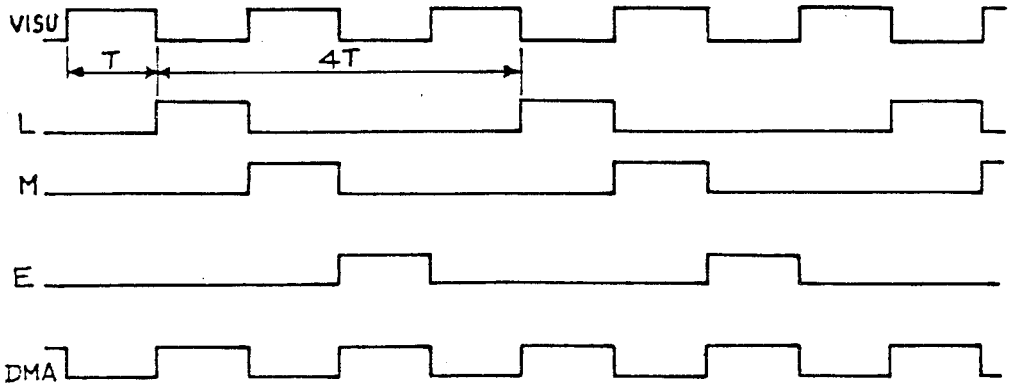

DEVICE FOR OBTAINING CONTINUOUS PLOTS ON THE SCREEN OF A DISPLAY CONSOLE CONTROLLED BY A GRAPHIC PROCESSOR

The present invention relates to a device for obtaining continuous plots on the screen of a display console dontrolled by a graphic processor.

BACKGROUND OF THE INVENTION

Display consoles adapted for plotting graphic images form images from an orderly matrix of points or pixels spaced regularly apart on the surface of the screen and whose pigmentation is determined as a function of the drawing or the graph which is to be made. This matrix is generally orthogonal and is formed by M×N pixels or points placed on the surface of the screen of the console at the intersections of M rows and N lines. The product M×N represents the total number of pixels or points visible on the screen of the console, on which the performance of the processor depends. In known constructions, the formats used go from dot matrices of 512 by 512 to 1024 by 1024 dots or pixels. These images are represented on the display controls or on the black and white or color television monitors by means of a "column-line" scanning system.

The line and frame television scanning method is appreciated in these devices for the numerous advantages which it offers, However, the sampled structure of the graphic memory which is interposed between the display console and the processor causes characteristic faults generally called "aliasing defects" which appear in the form of indentations or steps visible on the oblique portions and curved portions of the plots obtained on the screens when the image is fixed, or by the sudden disappearance or appearance of detail due to a slight movement of the image. These defects are mainly due to sampling the signal at discrete points of the image memory interposed between the screen of the console and the processor.

In high performance graphic equipment, these defects are corrected by different techniques consisting, for example, in increasing the definition of the displayed image or in increasing the capacity of the graphic memory by correlatively grouping together each pixel or point scanned with its neighboring points, or in compensating for the position rounded portions of the plot by varying the tint of the pixel surrounding the plot or else by carrying out treatments during reading of the graphic memory consisting in performing filtering and interpolation calculations on the signals read out from the graphic memory. In fact, the processors which consist in increasing the definitions of the displayed image tend to be replaced by filtering and interpolation processing processors which seem to be much more efficient and less costly. These processing methods have however the drawback of occupying much of the computing cycle time of the graphic processors, which makes these plotting methods relatively slow. For increasing the plotting rates, cabled logic circuits are used for replacing the software of graphic processors but these logic circuits have the drawback of being expensive and further requiring, for obtaining satisfactory corrections,intermediate processing by using for example cache memories, this processing being carried out at high speed and with high definition by exchanging data between the cache memory and the processor before the results are written into the graphic memory.

SUMMARY OF THE INVENTION

The aim of the invention is to overcome the above mentioned drawbacks.

For this, the invention provides a device for obtaining continuous plots on the screen of a display console controlled by a graphic processor, the image being formed by an orderly matrix of image points or pixels formed by M rows of N points or pixels scanned according to the same principle as television image scanning, the device comprising a graphic memory for storing in binary form the image of the matrix of the points displayed on the screen and an attribute memory for containing the attributes of each of the points of the image, further comprising an interpolation memory in which is stored a table for calculating the attributes of the intermediate points between consecutive points of the dot matrix, the table of the interpolation circuit being addressed at a first input by the pre-existing value PA of the pixel fo be modified found in the attribute memory, at a second input by the new value PN of the attribute of the pixels to be modified so as to cause them to appear in the plot and at a third input by an interpolation value F, calculated by the processor, equal to the fractional part of the position of the intermediate point to be modified, each position in the table containing an attribute value PM confirming the relationship $$PM=F.PA+(1-F).PN$$

the value PM obtained being transferred to the attribute memory so as to update the contents of the corresponding position at the address of the modified pixel.

BRIEF DESCRIPTION OF THE DRAWINGS

Other features and advantages of the invention will be clear from the following description with reference to the accompanying drawings given solely by way of example and in which:

FIGS. 1 to 3 show faults in the reconstruction of plots on graphic control screens generated by the sampling of points or pixels of the image matrix recorded in the graphic memory, FIGS. 4 to 5 illustrate known processes used in some graphic processors for obtaining plots not having any discontin city;

FIG. 6 shows the device of the invention for obtaining plots without discontinuities, FIG. 7 shows the timing diagram for the refreshing cycle of the screen of a display console according to the scanning principle used for television screens, of the cycle for reading, modifying or writing in the graphic memory as well as of the direct memory accessing DMA to the graphic memory;

FIG. 8 illustrates the linear interpolation method used by the invention for correcting the plot discontinuities.

DESCRIPTION OF THE PREFERRED EMBODIMENT

The theory of information shows that sampling time dependent signal S(t) at a rate $C_i$ leads to defects generally called "aliasing defects" if the frequency spectrum of the signal S(t) exceeds half the sampling frequency of the sampling signal. This defect results from overlapping between the upper half of the spectrum of the signal S(t) and the lower half when this latter is driven back about the frequency $/C_i$ 2 half of the timing frequency $C_i$ of the sampling signal.

In a two dimensional space, the sampled and discrete coordinates X and Y of the position of each point or pixel of a graphic memory organized in the manner of an orthogonal matrix having columns and lines, obey the same criteria, except however that for the graphic signal the variable is situated in the spatial domain and not in the time domain. If the spatial spectrum of the graphic signal exceeds half the spatial sampling frequency, the same "aliasing" defects are to be found for the graphic signals in the same way as for the time dependent signals.

Figure 1:
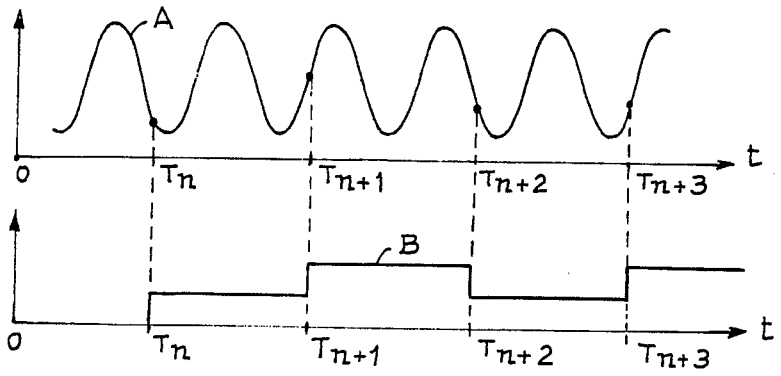

By way of example, FIG. 1 illustrates the defects in reconstructing a sinusoidal signal A sampled at times $T_n$ to $T_{n+3}$ spaced evenly apart and the reconstructed signal B which results therefrom and which appears indented in the form of a staircase, each level having a constant amplitude between two sampling times.

Figure 2:
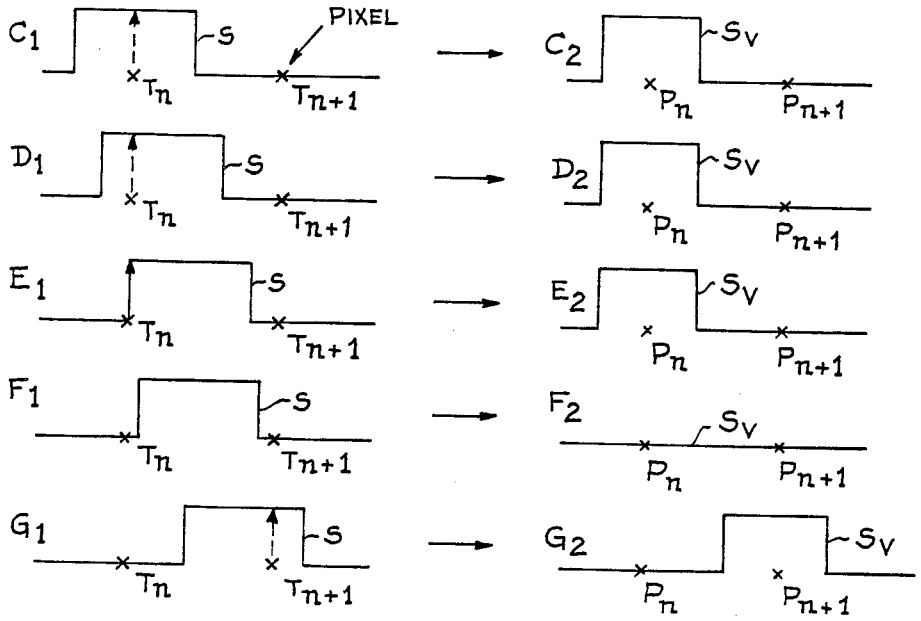

FIG. 2 illustrates the spatial "aliasing defects" generated by sampling signals at a fixed rate of a rectangular signal S representing the position of a point on a plot which is represented at the input of a graphic console whose memory is organized in the form of a dot matrix. Depending on the position of signal S with respect to the sampling times $T_n$ and $T_{n+1}$, it can be seen in FIG. 2 that this signal is or is not stored in the memory. In the case for example of signal S which is shown on line $F_1$ between the sampling times $T_n$ and $T_{n+1}$, the image of this signal (line $F_2$ )is not stored in the graphic memory since the point which it represents is intermediate between the position $P_n$ and $P_{n+1}$ in the graphic memory corresponding to the sampling times $T_n$ to $T_{n+1}$ and since consequently this signal cannot be displayed on the display console.

One way of overcoming this defect is shown in FIG. 3 and consists in filtering each input signal so as to transform it into a signal $S_F$ on the graphs $H_1$ to $M_1$ before sampling it for writing it into the graphic memory. The filtering constants are defined so that, whatever the position of the filtered signal with respect to the sampling times $T_n$ and $T_{n+1}$, there is always a signal sample which may be stored in the graphic memory, thus advantage is taken of the response constants of the screen which operates natural filtering, signal $S_V$ in graphs $H_2$ to $M_2$, on the size of the samples restored by the graphic memory.

Although it is relatively simple to filter a signal in the time domain, the spatial filtering which has just been described is however more complex to perform and in particular requires multiple accesses to the graphic memory in the direction of the lines and columns when the filtering used is two dimensional. FIGS. 4 and 5 illustrate a less complicated process giving good results which is sometimes used for obtaining plots without discontinuity on a screen of a graphic display console. FIG. 4 shows an oblique plot directed in direction D and obtained by joining side by side two words $M_1$ and $M_2$ of 7 pixels each, of the same tint $T_{16}$, disposed respectively on lines $L_n$ and $L_{n+1}$. The plot shown discloses a discontinuity at point 0 on passing from the upper line $L_n$ to the directly lower line $L_{n+1}$. To overcome this difficulty, known "anti-aliasing" correction devices operate according to the principle shown in FIG. 5 which shows the same plot as that of FIG. 4 which is obtained, as distinct from what is shown in FIG. 4, by correcting the tint of the pixels about the straight line Δ of direction D. The tint of the pixels surrounding the straight line Δ of direction D is weighted by an interpolation function which has as argument the positional error of each pixel with respect to the straight line Δ of direction D. The loss of modulation is negligible in this case and is largely compensated for by clearer contours. This process has however the disadvantage of requiring the use of software which penalizes the speed with which the plots may be made. The process of the invention overcomes these difficulties and consists in using a cabled device for carrying out the linear interpolation functions required during plotting so as to suppress the discontinuities, the principle of these interpolations consisting in modifying each pre-existing value of a pixel situated on or in the vicinity of the plot as a function of the new value of the pixels of the plot and of the position of the pixel with respect to the direction of the plot.

The device for implementing the process of the invention is shown inside a broken line 1 in FIG. 6. Device 1 is coupled between a processor 2 designated by the abbreviation CPU (Central Processing Unit) and a display console 3.

Device 1 comprises a graphic memory 4 which contains a binary matrix representation of all the characteristic points of the graphic image which is displayed on the display console 3, each information bit contained in the graphic memory 4 having for example the value 0 when it corresponds to the uniform background of the graphic diagram and the binary value 1 when it corresponds to a point or pixel of the graphic diagram which stands out against the background thereof. The graphic memory is organized in words of N bits representing the state of N pixels, each word being addressed either by the processor 2 or by the display console 3 through an address mutliplexing circuit 5 having two multiplexing inputs, a first multiplexing input being connected by the address line 6 to the address output of the processor 2 and a second address input being connected by the address line 7 to the address output of a display console 3. The output of the address mutliplexer 5 is connected to the addressing inputs of the graphic memory 4 through the address line 8. The words read out from the graphic memory 4 at the memory positions designated by the address words applied to the address line 8 are applied respectively to the inputs of a parallel-series register 10 and to the inputs of a multiplexing circuit 11. Device 1 also comprises an attribute memory 12 formed possibly by P additional memory planes in the graphic memory 4 which contains the attributes coded over P bits respective to each of the N pixels represented in each word of N bits contained in the graphic memory 4, this attribute memory 12 being addressed simultaneously with the graphic memory 4 by the address line 8. The words read out from the graphic memory and from the attribute memory 12 are applied to the circuits not shown of the display console 3, through register 10, so that the display console can display the pixels which they represent. The attribute words PA of each pixel, addressed by each of the address words applied to the address line 8, are applied by a data line 13 to a first input of an interpolation circuit 14 through the multiplexer 11 and a decoder 19 connected in series. The interpolation circuit 14 is connected by second and third inputs to the data outputs of the processor 2 by a data line 15. The modification data referenced FM and PN is applied by the data line 15 to the second and third inputs of the interpolation circuit 14, for modifying the values of the attributes PA applied to the first input of the interpolation circuit 14 by the data line 13. The output of the interpolation circuit 14 is connected by a data line 16 to a data input of a reformation circuit 17 for recording each attribute PN modified by the interpolation circuit 14 at the position which it occupies in the attribute memory 12. The reformation circuit 17 is also connected by a second input, by means of line 18, to the output of the decoder 19 addressed by the address line 8 and connected by its input to the output of the multiplexer 11. The purpose of decoder 19 addressed by the address line 8 is to select, within the word of N bits applied to the input of the multiplexer 11, each bit designated by the address word applied to its input and the attribute word PA coded over P bits which corresponds thereto. The bit representative of the selected pixel and its attribute PA are applied respectively to a fourth input and to the first input of the interpopulation circuit 14 for possibly modifying their values as a function of the interpolation data which is applied to the second and third inputs of the interpolation circuits 14. The bits not selected by the decoder 19 are applied by line 18 to the input of the reformation circuit 17 which reforms, depending on the information modified or not supplied at the output of the interpolation circuit 14, a new binary word which is applied to the input of a demultiplexing writing circuit 20 by means of a data line 21 for writing the word, possibly modified, and the corresponding attributes in the addresses which they normally occupy in the graphic memory 4 and the attribute memory 12. The data for modifying each of the words contained in the graphic memory 4 and the attribute memory 12 is fed in from a keyboard 22 which is connected to the processor 2 through the connection line 23. A mass memory 24 is possibly coupled by a line 25 to processor 18 for transferring into processor 2 the program instructions required for operating the whole. The processor 2 is also connected to a random access memory MMU 26 whose role is to store, during operation, the instructions and the data fed in from the keyboard 22 or from the mass memory 24.

The graphic memory of the invention is with dual accessing by cycle sharing. A first cycle is reserved for operation of the display console 3, a second cycle is reserved for operation of the modification procedure controlled by processor 2, this modification cycle being characterized by a cycle for reading, a cycle for modifying and a cycle for rewriting the modified information into the graphic memory and a third cycle for direct reading of the graphic memory, all these cycles being shown by the timing diagram in FIG. 7. The cycles shown in FIG. 7 are executed by the processor 2 which applies control signals to the control bus 27 for refreshing the points or pixels of the graphic diagram displayed on the screen of the display console and for controlling the writing and reading cycles of the different planes of the graphic memory 4 which contain the attributes of each pixel and which form the attribute memory 12. In FIG. 7, the refreshing cycle marked "VISU" of the display console is shown with a duration T and a period of 2T, the cycle L for reading the information contained in the graphic memory 4 and in the attribute memory 12 is shown interlaced during a period T outside the refreshing period of the display console 3 with a period of duration 4T, the modification cycle M follows the reading cycle L with the same duration T and the same period of equal duration 4T, the writing cycle E follows the modification cycle M with the same duration T and a period equal to 4T and the cycle for direct access to the graphic memory and to the attribute memory takes place during a time T between the refreshing times of the display console 3. By way of example, this method of cycle sharing may be advantageously used for displaying words of 16 pixels for a period of 1184 nanoseconds and the execution of reading-modification-writing cycles of twice 1184 nanoseconds per pixel or point to be modified which allows high operating ranges to be covered, for example the processing of 720 image points or pixels per scanning line over 576 lines while complying with the CCIR standard of 625 line television scanning, the output of the display console in this case corresponding to the digital television standard of 13.5 MHz for 25 images/second and the cycle time T being close to 400 nanoseconds. These results are obtained by organizing the graphic memory for example in words of 16 pixels and the attribute memory 12 in attribute words of three bits, each of the words being addressed by the processor 2 by the address bits applied to the address bus 8. Each word read out from the graphic memory 4 is applied to the input of multiplexer 11. The position of the bit in the word corresponding to the point or pixel to be modified is selected by multiplexer 11 and decoder 19 from the four lowest weight bits of the address word at the same time as the three corresponding attribute bits are addressed in the attribute memory 12 by the address bus 8. The bits of the word not designated by multiplexer 11 and decoder 19 are sent directly to the inputs of the word reformation device 17 while the selected bit is taken into account by the interpolation circuit 14. The three attribute bits read out from the attribute memory 12 corresponding to the point or to the pixel to be modified are applied to the first input of the interpolation circuit 14 while the processor 2 simultaneously applies over the data line 15, four modification bits PN at the same time as six function bits corresponding to the interpolation function FM chosen by the operator thus allowing 64 interpolation functions to be executed. The bits of the memory word selected and the corresponding attribute are modified so as to form a four bit word PM which is obtained at the output of the interpolation circuit 14 and which is a function of the value 0 or 1 of the bit of the point or of the pixel to be modified read out from the graphic memory 4, of the corresponding attribute read out from the attribute memory 12, of the modification data PN supplied by the processor 2 to the input of the interpolation circuit 14 and of the interpolation function also sent to the third input of the interpolation circuit 14 by processor 2.

For convenience of construction, the interpolation circuit is formed by electrically programmable read only memories of the type known as "EPROM" or from random access memoriesof the RAM type which store function tables for modification of the tint of the points of the image for implementing the interpolation process of the invention. At each pixel modification, these tables are addressed by the bits of the word PA read out from the attribute memory representing the pre-existing value of the modified pixel, by the new value PN of the pixel which it is desired to obtain for the points belonging to the plot and by an interpolation value which represents an intermediate address value between two adjacent pixels of the image matrix for determining the tint of the points of the screen situated in the intermediate space between the position of the pixels in the image matrix. The interpolation process is written into an interpolation program which is executed by processor 2 and whose steps may be carried out in the following way:

In a first step, processor 2 calculates the fractional address corresponding to the position of the pixel to be modified inside the points of the image matrix, this address being determined as a number F of interpolation steps in the horizontal and vertical directions of the image between two successive pixels $P_n$ and $P_{n+1}$ of the image matrix in the way shown in FIG. 8. By way of example, three fractional bits may be used for addressing the intermediate points situated between two pixels of the image matrix, which corresponds to eight successive interpolation steps. The process then consists in calculating in a second step the value PM of the pixel or point corresponding to the fractional address calculated according to the relationship $$PM=F.PA+(1-F).PN$$

This process may be applied for forming any plots on the screen of the display console, these plots being obtainable for example from the plot of several successive vectors connecting together well defined coordinate points on the screen.

This process has the advantage of being simple to implement for the plot of a vector connecting together two close coordinate points $(X_0,Y_0)$ and $(X_1$ and $Y_1)$ on the screen situated at the orthonormed axes X and Y only requires the writing of a few program lines. By adopting the notations $DX=X_1-X_0$ and $DY=Y_1-Y_0$ with $D_X>0$ and $DY>0$ and assuming that the position of two points is such that the absolute values $|DX|$ and $|DY|$ of the differences DX and DY together confirm the relationships $|DX|>|DY|$ the execution of the program is ensured in a first phase by calculating the increment which should be given in the vertical direction of the screen (axis Y) to each incrementation step executed in the horizontal direction (axis X). This first calculation phase is followed by a second initialization phase and a third execution phase, the whole of these three phases requiring the following succession of instructions:

| | |
|---|---|
| Calculation of the increment | DY1 = DY/DX < = 0 |
| Initialization | DY0 = 0 |
| | X = X0 |
| Start: | X = X + 1 |
| (3 bits) | DY0 = DY0 + DY1: F = Fractional part of DY0 |
| | Y = Y0 + whole part DY0 |
| | DY0 = DY0 − whole part DY0 |
| | Write X, Y, F |
| | Write X, Y + 1, (1 − F) |
| | If X > X1 or Y > Y1 end, if not, START |
| Writing procedure X, Y, F | (wired logic) |
| PN = new attribute | (supplied by CPU) |
| PA = old attribute | (supplied by memory) |
| PM = F*1 PA + (1 − F) * PN | |
| Write PM | |

Naturally, execution of the process of the invention is not limited to the program for plotting vectors which has just been described nor to the format of the attribute bits and pixels which may comprise a very extensive number of bits. At the programming level, a man skilled in the art may very readily devise other plotting programs for executing arcs of circles, ellipses or interpolated parametric curves by using functions of the BSPLINE or BEZIERS type without departing from the interpolation process of the invention. Also, since the above described anti-aliasing process is based on the amplitude value of the pixel, it is obvious that the correct results can only be obtained if the attribute defined for example over 4 bits can describe the 16 colors of a pixel within a range to be defined by another table of colors. The anti-aliasing process which has just been described in fact only relates to systems in which at least three attribute bits or pixels are reserved for the light intensity which differentiate them from the four bit systems only having a single intensity bit.

It will be readily understood that the anti-aliasing process of the invention only performs really well when the attributes are defined over lengths greater than four bits and more particularly for systems where the attribute comprises 8 bits and more.

What is claimed is:

1. A device for obtaining a continuous line between points on a plot on a screen of a graphic image television display controlled by a graphic processor, the points being ordered in the form of a matrix of fixed points on the screen said device comprising:

a graphic memory for storing all the points of the plot in binary form an attribute memory for containing the attributes of each of the points an interpolation circuit controlled by the graphic processor from instructions fed into the processor from a keyboard for entering a value PN of the attributes of consecutive points on the plot on either side of the point to be modified, said interpolation circuit comprising a memory for storing a table for calculating the attributes of the intermediate points between consecutive points of the plot the table of the interpolation circuit being addressed at a first input by the pre existing attribute PA of the point to be modified found in the attribute memory, at a second input by the said value PN and at a third input by an interpolation value F equal to the fractional part of the position of the intermediate point to be modified between said consecutive points on the plot, each position of the table containing an attribute value PM confirming the relationship $$PM=F.PA+(1-F).PN$$

the value PM obtained being transferred into the attribute memory for updating the contents of the position corresponding to the address of the modified point.

2. The device as claimed in claim 1, wherein said interpolation circuit is formed by at least one programmable memory for containing the table of the inter-polation circuit, said memory being addressed by the graphic processor and by the attribute bits of each attribute word selected from the attribute memory.

3. The device as claimed in claim 2, wherein said graphic memory is addressed by the display console and by the graphic processor through an address multiplexer controlled by the processor for sharing the graphic memory access cycles initialized by the display console and the processor.

4. The device as claimed in claim 3, wherein said graphic memory is organized in words of a fixed length.

5. The device as claimed in claim 4, wherein the accessing cycle of the processor to the graphic memory is broken down into a cycle for reading each word in which is to be found the bit of an image point to be modified, and for reading the corresponding attribute word from the attribute memory, followed by a cycle for modifying the bit of the corresponding point to be modified, identified inside the word read out from the graphic memory and for modifying the attribute word read out from the attribute memory, also followed by a cycle for rewriting the word containing the modified bit into the graphic memory and for rewriting the modified attribute word into the attribute memory.

6. The device as claimed in claim 2, wherein the programmable memories of the interpolation circuit are electrically programmable read only memories.

7. The device as claimed in claim 2, wherein the programmable memories of the interpolation circuit are random access memories.

* * * * *